United States Patent [19]

Criscimagna et al.

[11] 4,027,196

[45] May 31, 1977

[54] BILATERAL SELECTIVE BURST ERASE SYSTEM

[75] Inventors: Tony N. Criscimagna, Woodstock; Michael J. Steinmetz, Hurley, both of N.Y.

[73] Assignee: International Business Machines Corporation, Armonk, N.Y.

[22] Filed: Nov. 12, 1975

[21] Appl. No.: 631,254

[52] U.S. Cl. ..... 315/169 TV; 340/324 M

[51] Int. Cl.[2] ..... H05B 37/00; H05B 41/00;

[58] Field of Search ..... 315/169 TV; 340/324 M

[56] References Cited

UNITED STATES PATENTS

| | | | |
|---|---|---|---|
| 3,771,016 | 11/1973 | Toba et al. | 315/169 TV |
| 3,803,450 | 4/1974 | Trogdom | 315/169 TV |
| 3,824,580 | 7/1974 | Bringol | 315/169 TV |
| 3,851,212 | 11/1974 | Umeda et al. | 315/169 TV |
| 3,919,591 | 11/1975 | Criscimagna | 315/169 TV |
| 3,940,755 | 2/1976 | Shutoh | 315/169 TV |
| 3,958,151 | 5/1976 | Yano et al. | 315/169 TV |

*Primary Examiner*—Saxfield Chatmon, Jr.
*Attorney, Agent, or Firm*—Harry T. Berriman

[57] ABSTRACT

Erase waveforms effecting improved erase action are provided for a gas panel of the type in which light emitting cells are formed in an ionizable medium at the crossover point of a set of horizontally and vertically extending insulated wires. The erase waveforms include a burst of bipolar pairs of pulses, each pair comprising a low amplitude wide duration erase pulse followed by an opposite polarity narrowed sustain pulse. The burst of pulse pairs being applied during the time frame of a normal sustain operation.

10 Claims, 4 Drawing Figures

BILATERAL SELECTIVE BURST ERASE SYSTEM

RELATED APPLICATIONS

Application Ser. No. 268,219 of T. W. Criscimagna and A. O. Piston for "Method and Apparatus For Gas Panel Display" and application Ser. No. 375,252, now U.S. Pat. No. 3,919,591 of T. W. Criscimagna for "Gas Panel With Improved Write-Erase and Sustain Circuits and Apparatus" assigned to the assignee of the present application, provide background information that may be helpful in understanding the general area of this invention.

BACKGROUND OF THE INVENTION

This application relates to an improved erase system for multi-cell gas panel displays which provides a selective burst of bipolar signals to the particular cell in which erasing is desired.

Gas panels of the type to which this invention relates have two glass plates that are spaced apart by a seal to contain an ionizable medium. A set of horizontally extending insulated conductors are located on one glass plate and a set of vertically extending insulated conductors are located on the other plate. When a suitable voltage is applied between one horizontal conductor and one vertical conductor, ionization occurs at the crossover point of the two conductors and light is emitted. The crossover points are called cells, and a display pattern is formed by ionizing selected cells. The operation of initially ionizing a cell is called writing. Once a cell is written it is sustained by a continuously alternation potential called the sustainer. The operation of removing the wall charges from a previously written cell is called erasing. A cell is erased by applying a suitable voltage waveform to produce a controlled ionization so that the wall charge is reduced to or near to zero in the cell to discharge the cell. One object of this invention is to provide improved waveforms for erase operations.

As a result of the ionization that occurs during writing, positive and negative charges accumulate on opposite insulating walls of the cell. The voltage of this charge opposes the voltage applied between the vertical conductor and the horizontal conductor so that the sum of these voltages quickly falls below the voltage required for ionization and light is emitted from the cell for only a brief instant. The write voltage waveform is maintained for a sufficient interval after the light is extinguished for a substantial charge to be stored on the cell walls. After the write operation, periodic light output of the cell is sustained by an alternating polarity voltage that is called a sustain voltage. The sustain pulse following the write operation is opposite in polarity to the write pulse and thus is of the same polarity as the charge that was stored on the cell walls by the preceding write operation. Since the cell ionizes at a voltage that is the sum of the applied voltage and the voltage that is the sum of the applied voltage and the voltage of the stored charge, a previously written cell ionizes at an applied sustain voltage that is less than the write voltage. The sustain voltage is applied simultaneously to all cells and the previously written cells ionize and accumulate charge for the next sustain alternation but the previously erased cells with zero wall charge remain un-ionized.

A possible explanation for ionization in a gas panel will be helpful for understanding this invention. Independently of any voltage on the conductors of a cell, the cell medium ordinarily contains some free electrons and positive ions, and pilot lights may be located around the edge of the panel to establish a suitable level of ionization. The electrons and positive ions recombine and new ions are formed at an equalibrium rate. When a voltage is applied across the conductors of a cell, an electric field is formed in which the ions are accellerated so that ions collide more frequently with neutral atoms and thereby produce additional ions. At relatively low voltage levels an equalibrium condition may be reached where there is a high level of ionization but ions are lost by recombination as fast as they are created by collisions between atoms and ions. However, at some higher voltage level, ions are created faster than they are lost and these ions in turn produce additional ionization so that an avalance of free charges occurs. Thus, both of the height and the width of the cell voltage waveform are important in establishing whether avalanche ionization will occur. As has already been explained, avalance ionization is required for write, erase, and sustain operations.

It has been found that in attempting to do a selective erase operation, particularly in the case of erasing a cell which is surrounded by a number of lit cells to remain illuminated, the erase operation may be ineffective. It is believed that there are at present three basic techniques of erasing gas panel cells. One of these is the so-called narrow high amplitude erase which has the advantages that it erases better at Vs max. (sustain voltage maximum), it is insensitive to amplitude charges, it is selective and it is fast. It has the disadvantages that the high amplitude requires high voltage circuits for deselect and it is sensitive to width tolerances.

Another technique is the wide low amplitude erase which has the advantages that it is insensitive to width tolerances, low voltages may be used for deselect since it is a low amplitude erase, it is selective, and it is fast. It has the disadvantages that erasing at Vs max. may require critical amplitude adjustment and it is sensitive to amplitude tolerances.

Still another erase technique applies a burst of narrow sustain pulses which has the advantage that it is insensitive to width tolerances and erases at Vs max. very well. It has the disadvantages that it can not be applied selectively to only a desired cell or cells since it is on the sustain voltage and it is slow.

The subject improved erase technique has all of the advantages of the prior known erase techniques and none of the disadvantages. It is accordingly an object of this invention to provide a gas panel erase pulse technique that erases very well at Vs max., is insensitive to amplitude charges, is insensitive to width charges, is low amplitude and can be made selective with low voltage circuits for deselects, and is fast.

SUMMARY OF THE INVENTION

The erase waveform of this invention provides a wide low amplitude positive erase pulse for the selectric portion of the erase followed by a narrow high amplitude negative erase pulse for the unselected portion of the erase. A series of three of these bipolar pulse squares are provided, the series taking place in the normal time of a sustain pulse cycle. The wide low amplitude pulse permits low voltage circuitry to be used for the full select operation. The negative going narrow pulses of the erase series are generated by the normal sustain pulse circuitry and are simply narrowed versions of the erased sustain pulse. The negative going narrow pulses produce a better erase action of the Vs max. (V sustain maximum) and reduce the amplitude sensitivity of the wide selection erase pulse. A burst of these bipolar erase signals also decreases sensitivity to width and amplitude variation of the pulses and improves operation at Vs max.

Other objects, advantages, and features of the invention will be apparent from the following description of a detailed embodiment of the invention.

IN THE DRAWING

THE PREFERRED EMBODIMENTS

Figure 3:
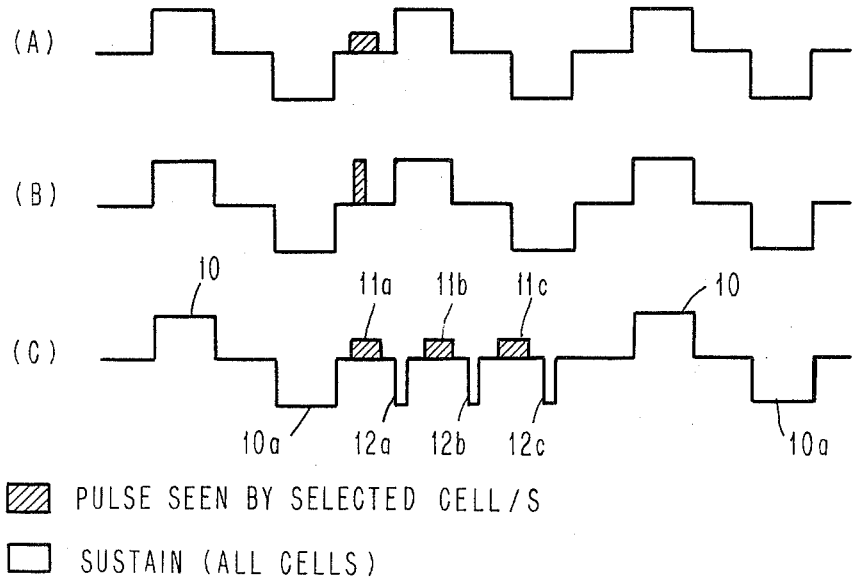
FIG. 3 shows simplified waveform representations of various erase techniques.

FIG. 3 waveform C shows in waveform representations the improved erase sequence of the subject application. In FIG. 3 waveform C the pulses designated 10 and **10*a* are the normal sustain pulse sequence applied to all cells in the usual manner to maintain previously illuminated (ignited) cells in the illuminated state until an erase operation is desired. The shaded low amplitude pulses 11*a*, 11*b*, and 11*c*, shown represent in part the improved erase pulse sequence applied to a selected cell to erase it. The erase pulses may for the particular panel used in this instance have a representable amplitude in the range of +20 to +80 volts and a representation duration of 1–3 micro-sec. Each pulse 11*a*, 11*b*, and 11*c* is followed by a negative polarity pulse alternation, 12*a*, 12*b* and 12*c*, respectively, which is actually a narrowed sustain pulse alternation. Three bipolar sequences of erase pulse such as lla followed by negative alternation 12*a* are shown. This is representative only since the three pulse sequences work best for the particular gas panel utilized. Dependent upon panel characteristics, time series of 2 or more pulse sequences may be utilized. The erase pulses 11a** etc. are shown shaded to indicate that they are applied only to the selected cell for erasing action. The narrowed sustain alternations are applied to all cells and are graphically represented as unshaded to illustrate this. In the particular panel utilized, the series of three erase bipolar alternations are applied during one normal sustain pulse alternation in the representative gas panel utilized or about 33 micro/sec. at 30 KHZ.

The A waveform as shown in FIG. 3 is a waveform representation of the commonly used prior art wide-low amplitude selective erase technique while the waveform B shown in FIG. 3 is a waveform representation of the prior art narrow-high amplitude selective erase technique. These prior art waveforms are shown as a frame of reference for the improved technique as shown by waveform (C). The detail circuit configuration for applying the improved erase pulse action to any selected cell of a gas panel display will now be described.

Figure 1:
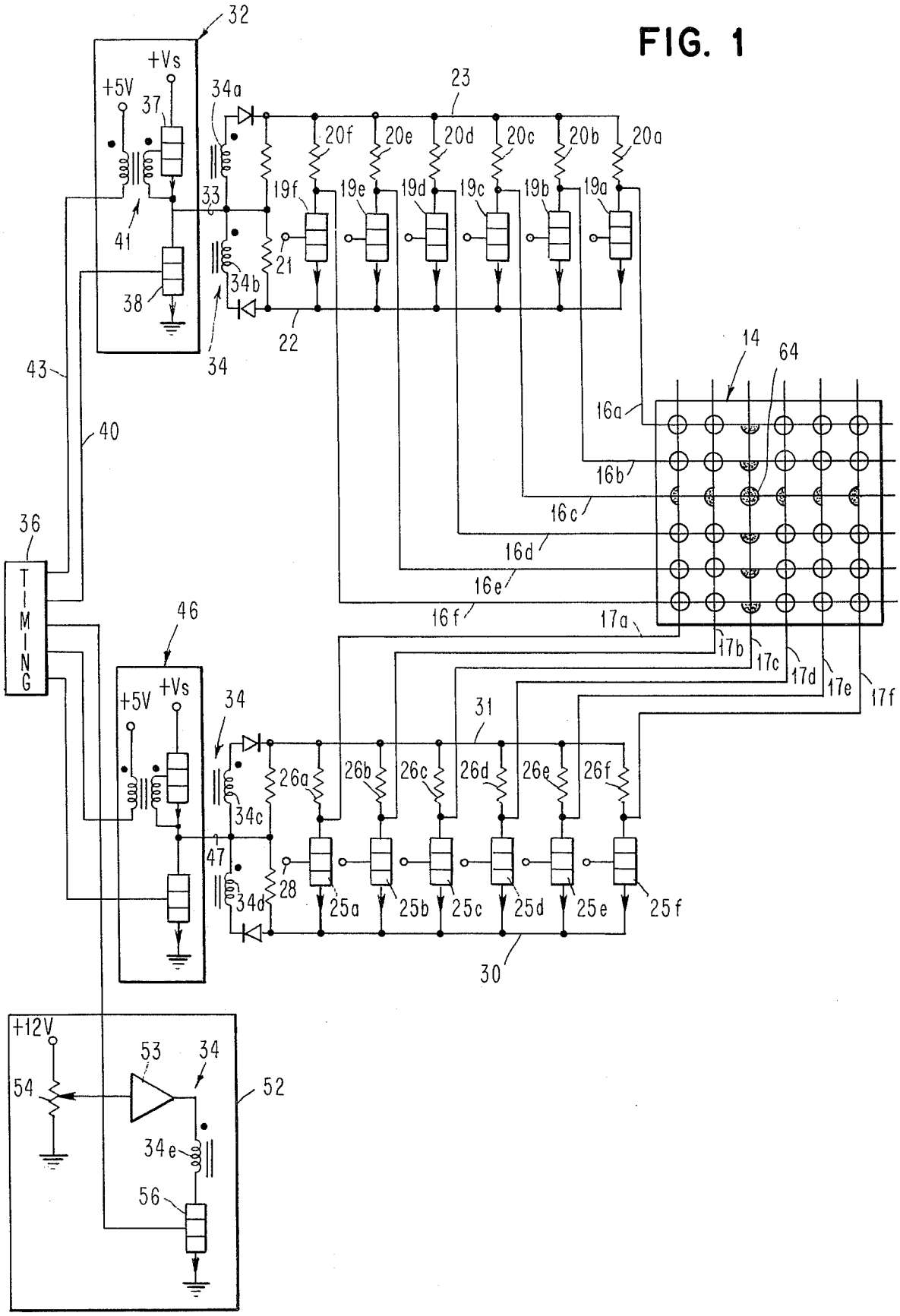
FIG. 1 shows the circuitry for producing the improved selective bipolar burst erase action at any desired cell of a gas panel display.

Referring now to FIG. 1, there is shown a representative 6 × 6 gas panel display 14 having six horizontal conductors **16*a*, 16*b*, 16*c*, 16*d*, 16*e* and 16*f* and six vertical conductors 17*a*, 17*b*, 17*c*, 17*d*, 17*e* and 17*f*. Transistors 19*a*, 19*b*, 19*c*, 19*d*, 19*e* and 19*f* and associated resistors 20*a*, 20*b*, 20*c*, 20*d*, 20*e* and 20*f* respond, as will be explained, in accordance with selection signals applied at their related base terminal input 21 to connect the horizontal conductors 16*a* to 16*f* to either a lower horizontal bus line 22 or an upper horizontal bus line 23. Similarly, transistors 25*a*, 25*b*, 25*c*, 25*d*, 25*e* and 25*f* and associated resistors 26*a*, 26*b*, 26*c*, 26*d*, 26*e* and 26*f* respond to selection signals applied at their related base terminal input 28 to connect the vertical conductors 17*a* to 17*f*, to either a vertical lower bus 30 or a vertical upper bus 31. During a write or erase operation, a selected cell of the display receives the voltage of upper horizontal bus 23 with respect to the voltage vertical lower bus 30, an unselected cell receives the voltage of lower horizontal bus 22 and upper vertical bus 31, while half selected cells receive the voltages of both upper busses 23 and 31, or both lower busses 22 and 30**.

Still referring to FIG. 1, a sustain circuit, generally indicatd 32 is provided to apply the sustain waveform through a conductor 33 and associated secondary winding **34*a* and 34*b* of a transformer 34 to the horizontal upper bus 23 and horizontal lower bus 22. The normal sustain waveform applied to the upper and lower horizontal busses is as indicated by the pulse 10 in waveform (A) FIG. 2 and comprises a square waveswing from zero potential to a +Vs potential as indicated. The sustain waveform is applied periodically under the control of a timing circuit 36. The sustain circuit 32 is of the active pull up and active pull down type and comprises a transistor 37 having its collector connected to a potential source of +Vs. The emitter of transistor 37 and the collector of a second transistor 38 are commanded and linked to the previously mentioned conductor 33. The base of transistor 38 is connected to the timing circuit 36 through conductor 40, and the base and emitter of transistor 37 parallel the secondary of a transformer 41, one leg of the primary winding of which is connected to the timing circuit 36 through conductor 43 and the other leg to a +5 volt supply. The sustain circuit functions as follows. Assuming NPN transistor 37 is off, the timing circuit through conductor 43 pulls down the lower end of the primary of the transformer 41 relative to the +5 volt supply. As a result, the secondary winding of transformer 41, which is similarly poled as the primary, is pulled down to lower the potential of the emitter of transistor 37 below its base and render transistor 37 conductive. With transistor 37 conductive, previously mentioned conductor 33 is at the sustain potential of +Vs. The timing circuit thereafter raises conductor 43 to shut off transistor 37, and raises conductor 40 to render transistor 38 conductive. With transistor 37 off and transistor 38 on, conductor 33** is now at ground potential.

Figure 2:
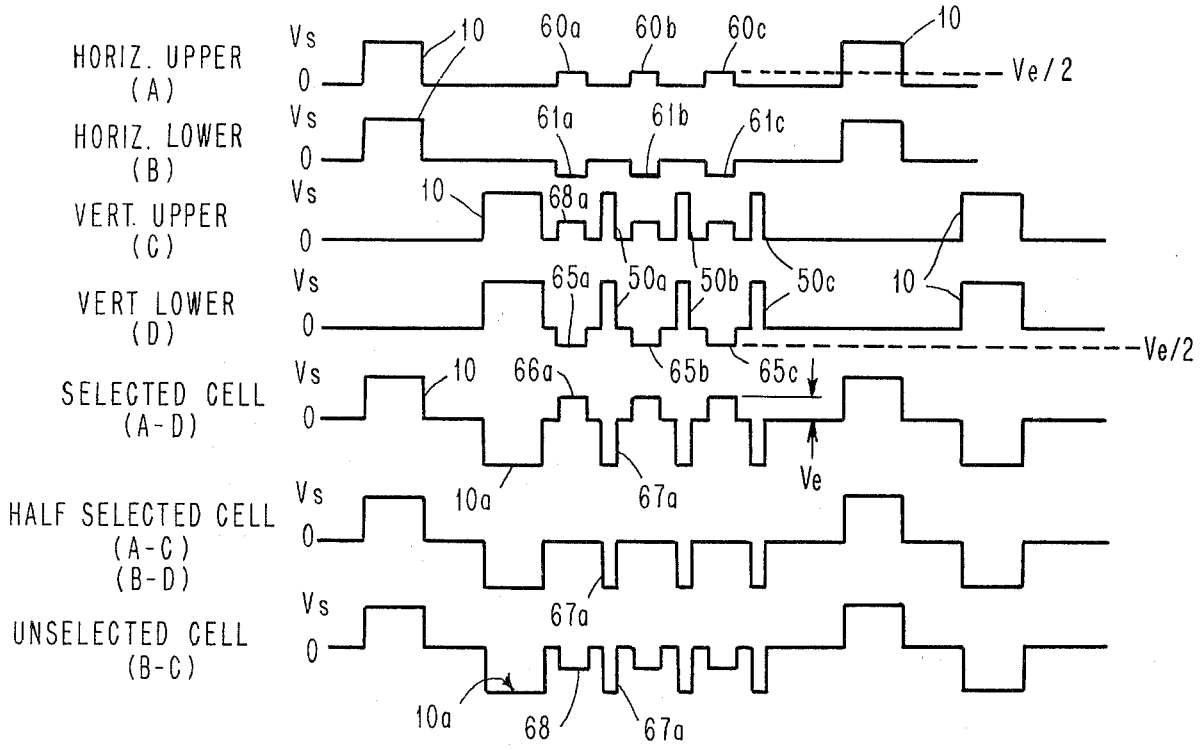
FIG. 2 shows waveforms that illustrate the operation of the circuit of FIG. 1.

A similar sustain circuit generally indicated at 46 in FIG. 1 is provided to apply a sustain pulse 10 as indicated in waveform (C) of FIG. 2 through a conductor 47 and associated secondary windings 34c and 34d of the same transformer 34 mentioned previously to the vertical upper bus 31 and vertical lower bus 30. The normal sustain waveform applied to the busses 30 and 31 again is a wide square wave which swings from zero potential to +Vs. It should be noted that sustain circuit 32 is operated by the timing circuit 36 to generate spaced square wave sustain pulses 10 as indicated on the horizontal busses 22 and 23. It will also be noted, that during an erase operation, the sustain circuit 46 operates to generate on the vertical busses 30 and 31, a normal sustain pulse 10 followed by three spaced narrow sustain alternations 50*a*, 50*b* and 5*c* as indicated in waveforms C and D in FIG. 2. These narrowed sustain alternations generate in turn, part of the new erase sequence on a selected cell as will later be evident.

Referring again to FIG. 1, an erase control circuit generally designated 52 is provided which comprises a primary winding 34*e* of the previously mentioned transformer 34, one lead of the winding being linked through a suitable amplifier 53 and potentiometer 54 to a +12 volt source. The other lead of the primary winding is connected to ground through transistor 56, the base of which is controlled from timing circuit 36. When an erase operation is desired, the timing circuit 36 turns on transistor 56 causing the transistor end of primary winding 34*e* of transformer 34 to swing to ground. The magnitude of this swing is adjustable by potentiometer 54, so that there is induced in the secondary windings 34*a*, 34*b*, 34*c* and 34*d*, an approximate 25 volt positive going voltage swing. The windings 34*a* and 34*b* are poled so that +25 volts are additive on horizontal upper bus 23 relative to the potential of horizontal sustain conductor 33 and subtractive on horizontal lower bus 22 relative to the potential of conductor 33. Accordingly, horizontal upper bus 23 goes 25 volts above sustain line 33 potential while the horizontal lower bus 22 goes 25 volts below line 33 potential.

The transformer secondary winding 34*c* and 34*d* associated with the vertical upper bus 31 and vertical lower bus 30 are similarly poled and respond in the same manner to drive the vertical upper bus 31,25 volts above the potential of vertical sustain line 47 and drive the lower vertical bus 25 volts below the potential of vertical sustain line 47. After a time period which may be in the range of 2–4 microseconds, the timing circuit 36 turns transistor 56 off to drop the voltage across primary winding 34*e* of transformer 34 to zero and accordingly causes a similar swing of the bus lines 22, 23, 30 and 31. The timing circuit 36 controls the transformer 34 primary in such a manner so that three spaced square waves 60*a*, 60*b* and 60*c* are generated in the horizontal upper bus 23 as illustrated in waveform A of FIG. 2, while three similar spaced negative square waves 61*a*, 61*b* and 61*c* are generated on the horizontal lower bus 22. The magnitude of these pulses is ½ the normal erase pulse magnitude for the gas panel.

The above described circuits provide the required structure for applying the improved erase waveform action to a selected cell of an array and a representative operation will now be described. Referring to FIG. 1, assume that the cell position 64, at the intersection of horizontal line 16*c*, and vertical line 17*c* was previously written into. Also assume that adjacent surrounding cells were also written into. After the write operation, sustain waveforms are applied in the usual manner to maintain each written cell in its illuminated state.

Assume now that it is desired to erase only cell 64, in the mid area of the plurality of illuminated cells. Conventional addressing circuitry (not shown) will accordingly turn associated transistor 19*c* OFF, and transistor 25*c* ON. With transistor 19*c* OFF, the upper horizontal bus 23 is linked through the resistor 20*c* associated with OFF transistor 19*c* to the horizontal line 16*c* of the display, the desired cell 64 being on this line. Similarly, the vertical lower bus 30 is linked through ON transistor 25*c* to the vertical line 17*c* of the display in which our desired cell 64 resides. Since this is an erase sequence, the previous described erase control circuit 52 and horizontal sustain circuit 32 are activated under timing circuit 36 control so that there is generated on the horizontal upper bus 23 the usual square wave sustain signal 10 followed by three spaced ½ select pulses of magnitude V erase/2 as represented by the waveform A of FIG. 2. This waveform is of course applied to the desired horizontal line 16*c* of the display which was selected as noted above. Similarly, the erase control circuit 52 and vertical sustain circuit 46 are actuated under timing circuit control so that there is generated on the vertical lower bus as shown in waveform D of FIG. 2, the usual square wave sustain signal 10, followed by a negative going ½ select voltage pulse 65 of Ve/2, followed by a shortened width sustain signal 50*a*, the half selects and shortened sustain cycle being repeated twice more before the generation of the normal sustain pulse 10. This waveform D of FIG. 2 is of course applied to the desired vertical line 17*c* of the display which was selected as noted above. With the application of the erase sequence waveforms of waveform A and D to the respective horizontal line 16*c* and vertical line 17*c* of the display, which of course intersects at the desired cell 64 which we wish to erase, the selected cell sees a resultant wave change as represented by the waveform A–D of FIG. 2 which is the algebraic resultant of the horizontal upper bus waveform A and the lower vertical bus waveform D. Examining the waveform A–D we note that it involves a normal width positive going sustain pulse 10, followed by a normal width negative going sustain pulse 10a, followed by a positive erase pulse 66*a*, which is twice the magnitude or Ve of the two half select erase pulses 60*a* (Ve/2) and 65*a* (Ve.2) of which it is comprised, followed by a narrowed negative going sustain pulse 67*a*. The full magnitude erase and narrowed sustain pulse sequence is repeated two more times on the selected cell to complete the erase action.

The action of the selection process to effect the erase function on a desired cell has the following action on the other cells on that same horizontal line 16*c*. The horizontal upper bus waveform A is of course seen by all cells on the line 16*c*, however, the related selection transistor 25 associated with all the remaining vertical lines other than line 17*c* remains OFF. Accordingly these OFF transistors cause the vertical upper bus 31 to be connected to all the associated vertical lines of the gas panel. The vertical upper bus has a waveform pattern as illustrated by the waveform C of FIG. 2 which includes a normal sustain pulse 10, followed by repetitive pairs of a deselect pulse 68 and a shortened duration sustain pulse 50*a* in the same direction as the deselect pulse 68. The resultant charge pattern seen by the non-selected cells on the horizontal line 16*c* is accordingly the algebraic addition of waveform A and C or waveform A–C as indicated in FIG. 2 for half selected cells. It will be noted in this waveform that the cells see a series of narrowed negative sustain pulses 67*a* but does not see the associated required erase pulse swing 66*a* so that no erase action takes place on these cells. The cells other than our desired cell 64 on horizontal display line 16*c* may accordingly be considered as only half selected and unaffected by the erase action.

Similarly, the action of the selection process to effect the erase or the desired cell 64 causes the following action on other cells on the same vertical line 17*c* of the display panel. The vertical lower bus waveform 30 is of course seen by all cells on vertical line 17*c*, however the selector transistor 19 associated with all the remaining horizontal lines other than line 16*c* remains ON. Accordingly, then ON transistors 19 cause the lower horizontal bus 22 to be connected to all remaining associated horizontal lines of the panel. The lower horizontal bus 22 has a waveform pattern thereon as illustrated by waveform B of FIG. 2 which includes a normal positive sustain pulse 10 followed by three spaced negative going deselect pulses 61*a*, 61*b* and 61*c* resulting from the action of transformer 34. The resultant waveform seen by the non-selected cells on the vertical line 17*c* is accordingly the algebraic addition of waveforms B and D or waveform B–D (identical to A–D). Here again no erase action takes place on these remaining cells in the selected vertical line 17*c* and they may be considered to be only half selected and unaffected by the erase action.

The action of the selection and subsequent erase action on the selected cell 64 has the following action on cells that reside on neither the selected horizontal line 16*c* or the vertical line 17*c* of the panel. These lines by reason of their related selection transistor 19 being ON have their related horizontal line 16 on the display subjected to the waveform B of the horizontal lower bus 22 and by reason of their related transistor 25 being OFF have their related vertical line 17 of the display subjected to the waveform C of the vertical upper bus 31. Here again the waveform at the intersections of these latter vertical and horizontal lines of the display are the resultant algebraic addition of waveforms B and C or waveform B–C. These cells are referred to as unselected cells and it is evident from waveform B–C that the cells are subjected after the usual sustain pulse operation, to a negative going low amplitude pulse 68 followed by the negative going shortened narrow sustain 67*a*. This latter pulse pair both being in the same direction as normal sustain 10*a* are of the wrong polarity to erase. There are three pairs of these pulses as illustrated in waveform B–C of FIG. 2. The unselected cells remain unaffected by the erase action.

It is thus evident that we have a circuit system where only the selected cell sees burst voltage disturbances that are of the right bipolar form and magnitude to effect erase, the other cells see disturbances of the wrong polarity to erase and therefore remain unaffected. The operation of selecting only a single cell has been described, however multiple cells on a line can also be selected or erased by appropriate conditioning of more than one transistor 19 and only one transistor 25 or vice versa.

Figure 4:
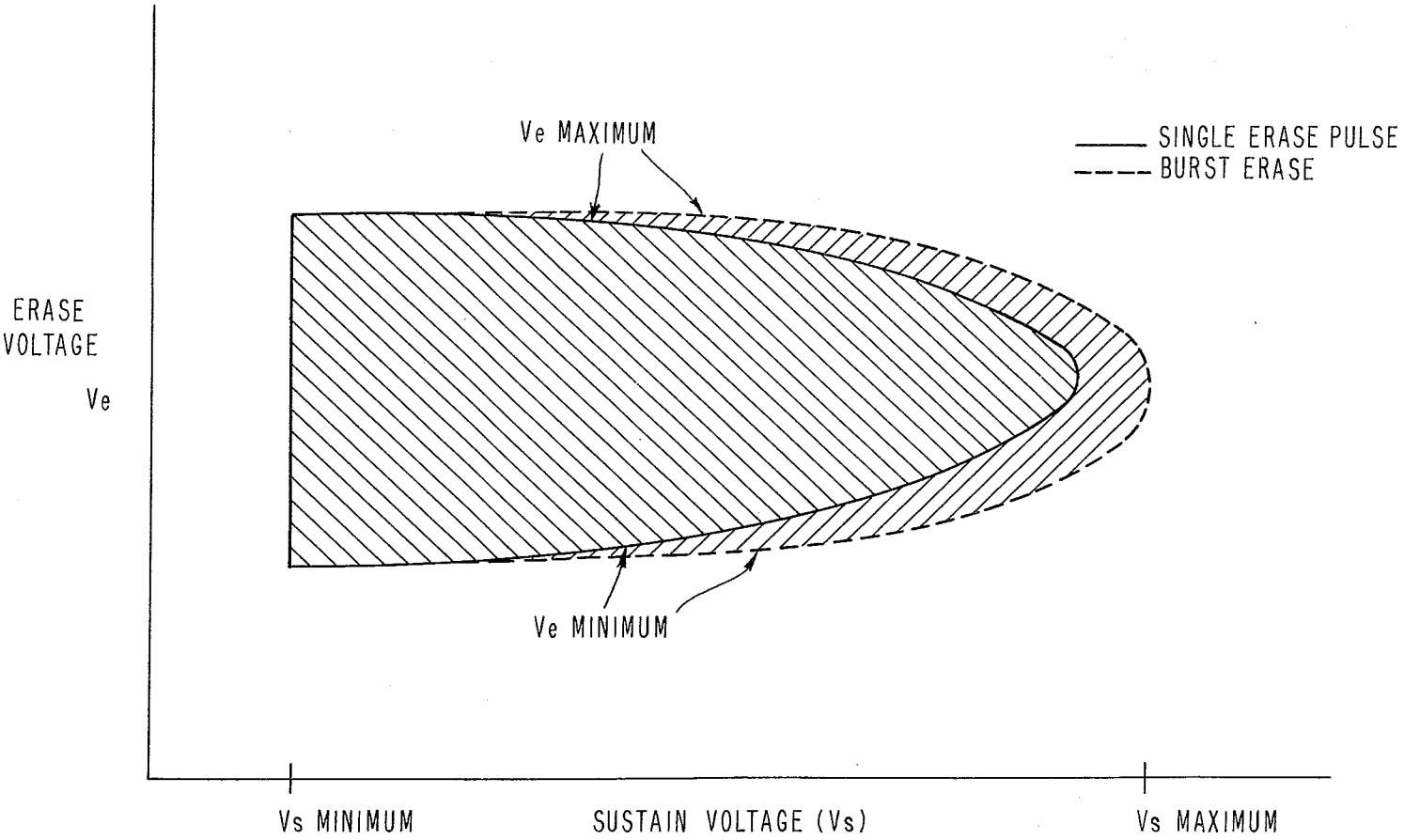
FIG. 4 is a chart representation of Vs (sustain) plotted against Ve (erase) and further illustrates the improved erase action.

Referring now to FIG. 4 which illustrates in general plots of erase voltage amplitude (Ve) versus sustain voltage (Vs) along the horizontal axis and two limiting voltage points for sustain voltage are indicated. Vs minimum is that point, below which cells previously written will not sustain. Vs maximum is that point above which cells not written will turn ON spontaneously without a write pulse. Obviously these two limits define the sustain voltage range of operation for a gas panel. The solid line plot illustrates the Ve maximum and minimum that will produce a successful erase operation for any given sustain voltage with only one erase pulse. It should be noted that there is no voltage Ve that will successfully erase the panel cells in question at Vs maximum. These cells in question are usually cells that are surrounded by lit cells. Consequently using the single pulse erase does not allow for maximum sustain voltage range inherent in the panel.

The dotted line plot illustrates the Ve maximum and minimum that will produce a successful erase operation for any given sustain voltage with a burst of erase pulses as described in this invention. In this plot the cells in question can be erased at Vs maximum by a burst of erase pulses thereby allowing full use of the panel's inherernt sustain voltage range.

While the invention has been shown and described with reference to preferred embodiments thereof, it will be understood by those skilled in the art that the foregoing and other changes in form and detail may be made therein without departing from the spirit and scope of the invention.

What is claimed is:

1. In a gas panel of the type having light emitting cells formed at crossover points of horizontal and vertical sets of conductors and in which avalanche ionization occurs in a light emitting cell at predetermined conditions of amplitude and width of pulses applied across the conductors of a cell, and having means for selectably producing pulses on said conductors to ignite desired cells by producing said avalanche condition and having circuit means for producing cyclical alternating polarity sustain pulses between said sets of conductors to sustain ignited cells in an ignited state, an erase system for effecting an improved erase action on only selected cells of said display comprising:

first signal generating means for generating a waveform comprised of a first series of low amplitude-wide erase pulses of one polarity, the amplitude of said pulses being ½ of the required magnitude to effect an erase action on an ignited cell;

second signal generating means for generating a waveform comprised of a second series of low amplitude-wide erase pulses of a polarity opposite to said first series, each pulse of said second series being followed by an associated narrow-high amplitude pulse of alternate polarity, each said erase pulses of said second series being ½ of the required magnitude to effect an erase action in an ignited cell and being time coincident with said erase pulses of said first series;

first selection means for applying the signals from said first signal generating means selectably, to any one or more horizontal conductors of said display on which cells to be erased reside; and second selection means for applying the signals from said second signal generating means selectably to any one or more vertical conductors of said display on which cells to be erased reside, any ignited cell lying at an intersection of any selected vertical and horizontal conductors being accordingly subjected to an additive pulse waveform of said first and second signal generating means to achieve an erase waveform of a series of bi-polar pulses each having an erase portion of full erase magnitude followed by a narrow high amplitude portion of opposite polarity.

2. The improved gas panel erase system of claim 1 further characterized in that the resultant bi-polar erase waveform applied to said selected cells to be erased is applied during the time of a normal sustain waveform cycle.

3. The improved gas panel erase apparatus of claim 2 further characterized in that said narrow high amplitude pulses produced by said second signal generating means are achieved by modifying the operation of said sustain circuit to generate narrowed sustain pulses of one polarity.

4. The improved gas panel erase apparatus of claim 1 further characterized in that each of said first and second selection means for selectably applying the related waveform to said display conductors, includes a respective first and second set of low voltage semiconductor switches.

5. In a gas display panel of the type having light emitting cells formed at crossover points of horizontal and vertical conductors and including control means for selectably writing or igniting desired cells and sustain circuitry for producing an alternating polarity sustain pulse waveform across the conductors for each cell to sustain previously written cells in an ignited state, the improvement comprising:

erase control apparatus having means to apply a waveform of a series of wide low amplitude erase signals of one polarity to a selected horizontal conductor of said display;

means to apply a waveform of series of coincident wide low amplitude erase signals of an opposite polarity to a selected vertical conductor of said display;

means to apply a waveform of a series of narrow high amplitude signals to all the vertical conductors of the display, said high amplitude signals being timed to occur between the time interval of each of said wide low amplitude signals and of a polarity on said selected vertical conductor opposed to the polarity of said wide low amplitude erase signals thereon, said signal waveforms on said selected vertical and horizontal conductors being algebraically effective on the selected cell at their intersection, as a series of bi-polar erase signals each having a wide low amplitude component of one polarity followed by a narrow high amplitude component of opposite polarity, each of said bi-polar erase signals effecting part of an erase function on said ignited cell, with said series effectively completely erasing said cell; and means for disabling the normal operation of said sustain circuitry, producing said alternating polarity sustain pulse waveform, for one cycle during the erase cycle.

6. Display panel erase apparatus as in claim 5 further characterized in that the amplitude of said wide low amplitude erase signals is a fractional part of the normal sustain pulse amplitude.

7. Display panel erase apparatus as in claim 6 further characterized in that said high amplitude signals are of magnitude equal to the peak sustain voltage pulse amplitude applied to said panel but of shortened duration relative to each normal sustain signal pulse.

8. Display panel apparatus as in claim 7 further characterized in that multiple written cell positions on a vertical or horizontal conductor can be selectably erased by applying said series of wide low amplitude erase signals to a related selected vertical conductor and to a plurality of associated selected horizontal conductors or a related selected horizontal conductor and a plurality of associated selected vertical conductors.

9. In a gas panel display of the type having light emitting cells formed at crossover points of horizontal and vertical coordinate conductors and including control means for selectably writing or igniting desired cells on said panel and sustain circuitry producing an alternating polarity sustain waveform across the conductors for each cell to sustain previously written cells in an ignited state, an erase circuit system for selectably erasing previously ignited cells by applying an erase waveform thereto comprising:

an upper and lower bus line for said horizontal display conductors;

an upper and lower bus line for said vertical display conductors;

first circuit means selectably operable during an erase operation for generating a series of spaced half select magnitude, wide low amplitude pulses on said horizontal upper bus, and a similar series of coincident but oppositely poled half select magnitude, wide-low amplitude pulses on said vertical lower bus;

second circuit means selectably operable during an erase operation to generate a series of narrowed sustain waveforms on said vertical bus lines, each said narrowed pulses being spaced in time to follow a related one of said wide-low amplitude pulses; and a first plurality of low voltage semiconductor switches selectably operable for an erase operation, to connect said upper horizontal bus to the desired horizontal display line or lines on which cells to be erased reside; and a second plurality of low voltage switches selectably operable coincidentally with said first group switches for an erase operation for selectably connecting said lower vertical bus to the vertical display line or lines on which cells to be erased reside; said switch operation effecting a combined application to said cells to be erased of the waveforms on said upper and lower busses to give an erase waveform of a series of bi-polar erase pulses, each having a wide low amplitude full select magnitude portion followed by an oppositely poled narrowed sustain waveform portion.

10. The improved gas panel erase system of claim 9 further characterized in that said first circuit means includes a common transformer having separate secondary windings linked to each said respective upper horizontal and lower vertical busses, a primary of said transformer being driven during an erase operation to generate on said secondary windings said half select magnitude pulses for application to said respective upper horizontal and lower vertical busses.

* * * * *